US010096196B2

(12) United States Patent
Recio

(10) Patent No.: US 10,096,196 B2
(45) Date of Patent: Oct. 9, 2018

(54) TRANSACTION MANAGEMENT METHOD AND ASSOCIATED SYSTEM

(71) Applicant: PARKEON, Paris (FR)

(72) Inventor: Sebastien Recio, Besancon (FR)

(73) Assignee: PARKEON, Paris (FR)

( * ) Notice: Subject to any disclaimer, the term of this patent is extended or adjusted under 35 U.S.C. 154(b) by 0 days.

(21) Appl. No.: 14/933,181

(22) Filed: Nov. 5, 2015

(65) Prior Publication Data

US 2016/0133082 A1 May 12, 2016

(30) Foreign Application Priority Data

Nov. 6, 2014 (FR) ..... 14 60734

(51) Int. Cl.
*G07F 9/02* (2006.01)
*G07F 11/00* (2006.01)

(52) U.S. Cl.
CPC ..... *G07F 9/026* (2013.01); *G07F 9/02* (2013.01); *G07F 11/002* (2013.01)

(58) Field of Classification Search
CPC ..... G07F 9/026; G07F 11/002
USPC ..... 705/14.38; 700/236, 244; 221/21
See application file for complete search history.

(56) References Cited

U.S. PATENT DOCUMENTS 6,675,067 B2 * 1/2004 Blad ..... G07F 11/002 700/236
6,772,906 B2 * 8/2004 Wittern, Jr. ..... G07F 9/026 221/21
7,366,586 B2 * 4/2008 Kaplan ..... G06Q 10/06311 221/14
7,801,745 B2 * 9/2010 Walker ..... G06F 19/3462 221/125
8,490,864 B2 * 7/2013 Votaw ..... G06F 21/31 235/375
2006/0241966 A1 * 10/2006 Walker ..... G06Q 20/20 700/232
2008/0249658 A1 * 10/2008 Walker ..... G07F 9/02 700/244
2010/0211218 A1 * 8/2010 Breitenbach ..... G06Q 10/087 700/237

(Continued)

FOREIGN PATENT DOCUMENTS

WO 2006/009730 A1 1/2006

OTHER PUBLICATIONS

FR Search Report, dated May 22, 2015, from corresponding FR application.

*Primary Examiner* — Timothy R Waggoner
(74) *Attorney, Agent, or Firm* — Young & Thompson

(57) ABSTRACT

A management method for transactions done by at least one automatic distribution machine (12_1, 12_2), includes the following steps:

detecting a malfunction during a transaction of a first automatic distribution machine (12_1, 12_2) with a user of the first automatic distribution machine (12_1, 12_2), the malfunction creating a harm for the user, generating an identifier, at least part of the identifier being specific to the detected malfunction and the identifier (28) being intended to be introduced into a second automatic distribution machine (12_1, 12_2), the introduction making it possible for the second automatic distribution machine (12_1, 12_2) to take an action to compensate the harm suffered by the user, and creating a ticket including the identifier.

9 Claims, 1 Drawing Sheet

(56) References Cited

U.S. PATENT DOCUMENTS

2015/0331903 A1* 11/2015 Blanco ..... G06F 3/0484
707/766

* cited by examiner

TRANSACTION MANAGEMENT METHOD AND ASSOCIATED SYSTEM

FIELD OF THE INVENTION

The present invention relates to a management method for transactions done by at least one automatic distribution machine. The invention also relates to a management system for transactions done by at least one automatic machine.

BACKGROUND OF THE INVENTION

In many technological fields, automatic distribution machines are used. An automatic distribution machine is a machine that makes it possible to obtain goods or services, without human intervention (self-service), using automatic techniques.

Hot or cool beverage dispensing machines are examples of distribution machines in the food field. Automatic distribution machines are also being developed to deliver other products to consumers. For example, in swimming pools, distribution machines allow users to order items to comply with hygiene regulations, such as a swimsuit or bathing cap. In the banking field, automatic machines making it possible to withdraw money have also been developed. In transportation, terminals make it possible to obtain transport tickets.

Automatic distribution machines make it possible to automate and accelerate distribution or ordering of a service by a user.

When an automatic distribution machine proves unable to make change or deliver the ordered product, the automatic distribution machine gives the user a ticket that is usually called "harm ticket". Such a ticket makes it possible to submit a claim to a human being at a window.

However, such a process is time-consuming, in particular if a large number of users come to the window.

There is therefore a need for a management method for transactions done by at least one automatic distribution machine making it possible to automate and accelerate distribution or ordering of a service to or by a user.

SUMMARY OF THE INVENTION

To that end, a management method is proposed for transactions done by at least one automatic distribution machine, including the steps of detecting a malfunction during a transaction of a first automatic distribution machine with a user of the first automatic distribution machine, the malfunction creating a harm for the user; generating an identifier, at least part of the identifier being specific to the detected malfunction and the identifier being intended to be introduced into a second automatic distribution machine, the introduction making it possible for the second automatic distribution machines to take an action to compensate the harm suffered by the user; and creating a ticket including the identifier.

According to specific embodiments, the method comprises one or more of the following features, considered alone or according to any technically possible combinations:

- the step for generating an identifier comprises a step for encrypting the identifier.
- the identifier comprises several parts, one of the parts being specific to the first automatic distribution machine.
- the method further includes a step for introducing the identifier in the second automatic distribution machine, and the second automatic distribution machine taking action to compensate the harm generated by the malfunction having the specific identifier.
- the method further includes a step for defining a validity date of the identifier, the validity date being designed to prevent the second automatic distribution machine from taking an action to compensate the user's harm when the introduction date of the identifier into the second automatic distribution machine is after the validity date.
- the transactions are done by a plurality of automatic distribution machines, each automatic distribution machine being connected to a same monitoring device, the step for generating an identifier being carried out by the monitoring device and the method further including a step for sending a request to generate an identifier from the first automatic distribution machine to the monitoring device and communicating the generated identifier from the monitoring device to the first automatic distribution machine.
- when there is a faulty connection between the first automatic distribution machine and the monitoring device, the step of generating the identifier is carried out by the first automatic distribution machine.

Also proposed is a management system for transactions done by at least one automatic distribution machine including a malfunction detector able to detect a malfunction during a transaction of a first automatic distribution machine with a user, the malfunction generating a harm for the user; a unit for generating an identifier, at least part of the identifier being specific to the detected malfunction and the identifier being intended to be introduced into a second automatic distribution machine, the introduction making it possible for the second automatic distribution machine to take an action to compensate the harm suffered by the user; and a unit for creating a ticket including the identifier.

According to one particular embodiment, the management system further includes each automatic distribution machine, a monitoring device, each automatic distribution machine being connected to the monitoring device, and wherein the unit for generating an identifier includes a plurality of sub-units for generating an identifier, each automatic distribution machine and the monitoring device each including a generating sub-unit.

BRIEF DESCRIPTION OF THE DRAWINGS

Other features and advantages of the invention will appear upon reading the following description of embodiments of the invention, provided as an example only and in reference to the drawings, which are.

DETAILED DESCRIPTION OF THE INVENTION

Figure 1:
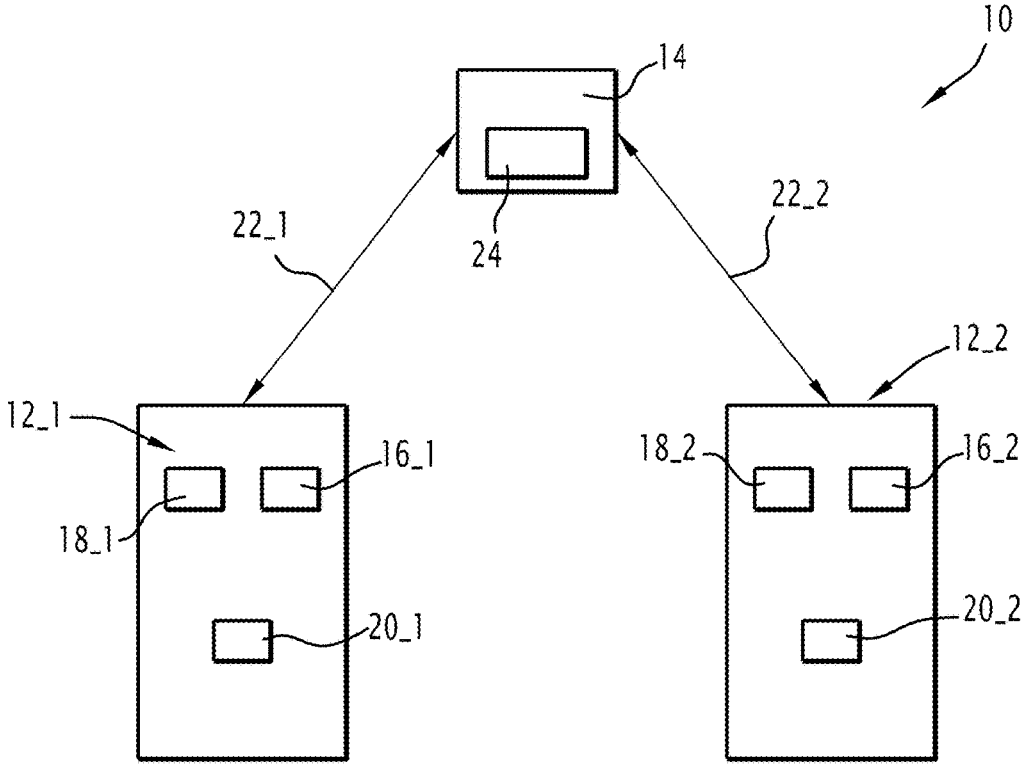
FIG. 1, a diagrammatic illustration of an example system for managing transactions done by at least one automatic machine, and FIG. 2, a view of an example ticket obtained using the system of FIG. 1.

The management system 10 is shown in FIG. 1.

The management system 10 includes two automatic distribution machines 12_1, 12_2 and a monitoring device 14.

The first automatic distribution machine 12_1 is connected to the monitoring device 14.

The first automatic distribution machine 12_1 is able to distribute a service or a ticket providing access to a service to a user. In this sense, a ticket is a document attesting to the acquisition of a right or a purchase.

As an example, for the case of FIG. 1, it is assumed that the first automatic distribution machine 12_1 is a timestamping machine allowing the user to park his vehicle in a predefined location in return for payment.

The first automatic distribution machine 12_1 comprises a first malfunction detector 16_1, a first local generating sub-unit 18_1 and a first creation unit 20_1.

The first malfunction detector 16_1 is able to detect a malfunction during a transaction of a first automatic distribution machine 12_1 with a user.

The malfunctions that the first malfunction detector 16_1 is able to detect create a harm for the user.

In the present context, the harm is financial.

For example, the first automatic distribution machine 12_1 does not give the change owed to the user or the first automatic distribution machine 12_1 does not give the user a ticket certifying that the user has made the payment related to the parking of his vehicle in the predefined location. Such cases are concrete illustrations of a malfunction of the first automatic distribution machine 12_1 generating a harm for the user.

The first local generating sub-unit 18_1 is able to generate an identifier when the connection of the first automatic distribution machine 12_1 to the generating device 14 is faulty.

The identifier is, for example, a number or a sequence of characters.

According to another embodiment, the identifier is a barcode.

At least part of the identifier is specific to the detected malfunction.

Furthermore, the identifier is intended to be introduced into the second automatic distribution machine 12_2, the introduction making it possible for the second automatic distribution machine 12_2 to take action to compensate the users harm.

The first creation unit 20_1 is able to create a ticket including the identifier.

The ticket is for example a paper ticket.

Alternatively, the ticket is a card comprising a memory in which the identifier is stored.

Similarly, the second automatic distribution machine 12_2 is connected to the monitoring device 14.

The second automatic distribution machine 122 is able to distribute a service or a ticket providing access to a service to a user. In the illustrated case, the second automatic distribution machine 12_2 is also a timestamping machine.

The second automatic distribution machine 12_2 comprises a second malfunction detector 16_2, a second local generating sub-unit 18_2 and a second creation unit 20_2.

The second malfunction detector 16_2 is able to detect a malfunction during a transaction of the second automatic distribution machine 12_2 with a user as long as the malfunction generates a harm for the user.

The second local generating sub-unit 18_2 is able to generate an identifier when the connection of the second automatic distribution machine 12_2 to the monitoring device 14 is faulty.

At least part of the identifier is specific to the detected malfunction.

Furthermore, the identifier is designed to be introduced into the first automatic distribution machine 12_1, the introduction making it possible for the first automatic distribution machine 12_1 to take action to compensate the users harm.

The second creation unit 20_2 is able to create a ticket including the identifier.

The monitoring device 14 is able to exchange information with the automatic distribution machines 12_1 and 12_2 to provide centralized monitoring of the creation of identifiers.

As previously explained, the monitoring device 14 is connected with the first automatic distribution device 12_1 on the one hand and with the second automatic distribution device 12_2 on the other hand. Each of these connections is symbolized in FIG. 1 by arrows 22_1 and 22_2.

Because the first automatic distribution machine 12_1 and the second automatic distribution machine 12_2 are connected to the same monitoring device 14, the monitoring device 14 corresponds to a "central" device, as opposed to automatic distribution machines 12_1 and 12_2 that are "local" devices.

The monitoring device 14 is for example a centralized server.

The monitoring device 14 comprises a central generating sub-unit 24.

The central generating unit 24 is able to generate an identifier when the connections 22_1 and 22_2 with the automatic distribution machines 12_1 and 12_2 are functional.

At least part of the identifier is specific to the detected malfunction.

Furthermore, the identifier is intended to be introduced into an automatic distribution machine 12_1 and 12_2, the introduction making it possible for the automatic distribution machine 12_1 and 12_2 to take action to compensate the user's harm.

The assembly of the various generating sub-units 18_1, 18_2 and 24 forms a unit for generating the identifier belonging to the management system 10.

The operation of the management system 10 shown in FIG. 1 will now be described in reference to a management method for transactions done by the automatic distribution machines 12_1 and 12_2.

In a first case, it is assumed that the connection 22_1 between the first automatic distribution machine 12_1 and the monitoring device 14 is functional.

The management method then includes seven steps: a detection step, a transmission step, a generating step, a communication step, a creation step, an introduction step and an implementation step.

During the detection step, a malfunction is detected during a transaction of the first automatic distribution machine 12_1 with a user of the first automatic distribution machine 12_1. The malfunction generates a harm for the user.

The detection step is carried out using the first malfunction detector 16_1.

During the transmission step, the first automatic distribution machine 12_1 sends a request to generate an identifier to the monitoring device 14. The monitoring device 14 then receive the generating request sent by the first automatic distribution machine 12_1.

During the generating step, the monitoring device 14 generates an identifier. At least part of the identifier is specific to the malfunction detected in the detection step.

The identifier is intended to be introduced into the second automatic distribution machine 12_2, the introduction making it possible for the second automatic distribution machine 12_2 to take an action to compensate the user's harm.

The generating step is carried out by the central generating unit 24. Such a centralized generation guarantees the security of the identifiers.

According to one particular embodiment, in the generating step, the central generating sub-unit 24 generates a number, then encrypts the number to obtain the identifier.

Such an encryption increases the security of the identifiers. Indeed, the identifiers become unpredictable.

Encryption consists of adding a random part to the number.

According to another embodiment, in the generating step, the identifier comprises several parts, one of the parts being specific to the first automatic distribution machine 12_1. This makes it possible to guarantee the uniqueness of the identifier, since part of the identifier is specific to the first automatic distribution machine 12_1.

Hereinafter, the identifier is assumed to be "1234567".

During the communication step, the monitoring device 14 sends the generated identifier to the first automatic distribution machine 12_1. The first automatic distribution machine 12_1 receives the identifier.

During the creation step, the first automatic distribution machine 12_1 issues the user a ticket including the identifier.

The creation step is, for example, a step for printing a paper ticket.

Figure 2:
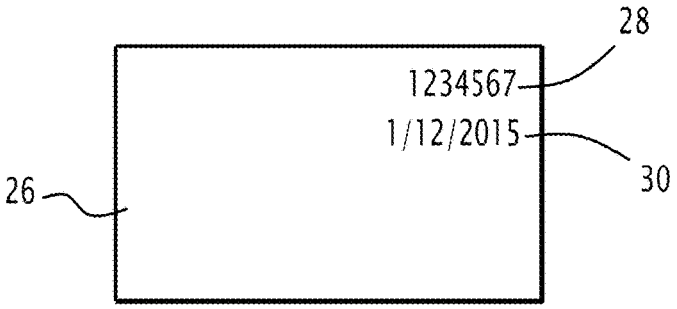

One example of such a ticket 26 is shown in FIG. 2. On the ticket 26, the identifier 28, which is "1234567", has been printed.

During the introduction step, the user introduces the identifier 28 into the second automatic distribution machine 122.

According to the embodiments, the introduction step takes place just after the creation step or later.

Typically, when change is not given, instead of seeking the immediate return of the money, some users prefer to reduce the amount to be paid the next time they park. In such a situation, the time gap between the introduction step and the creation step is generally greater than at least one day.

The introduction of the identifier 28 causes the second automatic distribution machine 12_2 to take an action to compensate the injury generated by the malfunction to which the identifier 28 is specific.

In a second case, it is assumed that the connection 22_1 between the first automatic distribution machine 12_1 and the monitoring device 14 is nonfunctional.

The management method then includes five steps: a detection step, a generating step, a creation step, an introduction step and an implementation step.

During the detection step, a malfunction is detected during a transaction of the first automatic distribution machine 12_1 with a user of the first automatic distribution machine 12_1. The malfunction generates a harm for the user.

The detection step is carried out using the first malfunction detector 16_1.

During the generating step, the first local generating sub-unit 18_1 generates an identifier. At least part of the identifier is specific to the malfunction detected in the detection step.

The identifier is intended to be introduced into the first automatic distribution machine 12_1, the introduction making it possible for the first automatic distribution machine 12_1 to take an action to compensate the user's harm.

The generating step is carried out by the first local generating sub-unit 18_1.

Hereinafter, the identifier is assumed to be "1234567".

During the creation step, the first automatic distribution machine 12_1 issues the user a ticket 26 including the identifier 28.

During the introduction step, the user introduces the identifier 28 into the first automatic distribution machine 12_1.

The introduction of the identifier 28 causes the first automatic distribution machine 12_1 to take an action to compensate the injury generated by the malfunction to which the identifier 28 is specific.

In all cases, the management method makes it possible to associate a secure unique identifier 28 with the ticket 26. The identifier 28 will make it possible to obtain goods (or reimbursement) during a future transaction directly on one of the automatic distribution machines 12_1 and 12_2, without having to visit an office.

Indeed, irrespective of whether the connections 22_1 and 22_2 are functional, the management system 10 makes it possible to generate the identifier 28. The management system 10 in particular makes it possible to generate harm tickets when the communication between the automatic distribution machines 12_1 and 12_2 and the monitoring device 14 is broken.

It appears that the management method for the transactions done by the two automatic distribution machines 12_1 and 12_2 allows the user to compensate the harm generated by the malfunction of the automatic distribution machine 12_1 and 12_2 without seeing a human being at a window.

In other words, the management system 10 makes it possible to avoid an intervention by outside resources at the automatic distribution machines 12_1 and 12_2 (for example, a person in an office) and allows the user to resolve the malfunction himself without having to wait.

The management system 10 is thus a self-managed "lost ticket" system usable on automatic distribution machines. The management system 10 indeed gives a third party (in this case, the user) the ability to resolve a limitation or failure of an automatic distribution machine without an intervention by the owner of said automatic distribution machine or one of the owner's employees.

This therefore makes it possible to automate and accelerate the distribution or ordering of a service to or by a user.

Furthermore, due to the self-management of the generation of the tickets 26, the management system 10 makes it possible to protect against risks of fraud by illegal copying or reproduction of the tickets 26, without human intervention.

The management system 10 applies to all types of automatic distribution machines. In particular, the management system 10 is particularly suitable for an automatic distribution machine with no pre-cash box. The management system 10 also makes it possible to manage an automatic distribution machine accepting electronic payments not making it possible to change the actual amount in case of distribution error. The management system 10 also applies to an automatic distribution machine with a limited pre-cash box. Limiting the pre-cash box potentially involves even more malfunctions if the automatic distribution machine accepts payment using bills.

Furthermore, for the operator, the management system 10 makes it possible to reduce costs, since the management of the tickets 26 is automatic (no human intervention by an employee of the operator).

In order to increase such an effect, according to the illustrated example, the management method further includes a step for defining a validity date of the identifier, the validity date being intended to prevent the second automatic distribution machine 12_2 from taking an action to compensate the user's harm when the introduction date of the identifier 28 in the second automatic distribution machine 12_2 is after the expiration date. In the example of FIG. 2, the expiration date 30 indicated on the ticket 26 is Dec. 1, 2015. Furthermore, this has the advantage of encouraging the user to use the created ticket 26 right away on another automatic distribution machine 12_1 and 12_2.

Other embodiments can be considered.

In particular, there may be any number of automatic distribution machines, the management system 10 being suitable for managing as many automatic distribution machines as desired.

Furthermore, according to one embodiment, the automatic distributional machine 12_1 and 12_2 compensating the harm is the automatic distribution machine having caused the harm, whether the connection with the monitoring device 14 is functional or not.

Alternatively, the management system 10 does not include a monitoring device 14, all of the identifiers being generated locally by the automatic distribution machines 12_1 and 12_2.

According to another embodiment, after reestablishing a connection, the identifier 28 generated locally is made usable on all of the other automatic distribution machines 12_1 and 12_2.

The invention claimed is:

1. A management method for transactions done by at least one automatic distribution machine, the method comprising the following steps:

detecting a malfunction during a transaction of a first automatic distribution machine with a user of the first automatic distribution machine, the malfunction creating a harm for the user, generating an identifier, at least part of the identifier being specific to the detected malfunction, the identifier being intended to be introduced into a second automatic distribution machine, an introduction of the identifier allowing the second automatic distribution machine to take an action to compensate the harm suffered by the user, defining a validity date of the identifier, the validity date preventing the second automatic distribution machine from carrying out an action to compensate the user's harm when an introduction date of the identifier into the second automatic distribution machine is later than the validity date, creating a ticket including the identifier, wherein the transactions are done by a plurality of said automatic distribution machines, each of said automatic distribution machines being connected to a same monitoring device, and the step for generating the identifier is carried out by the monitoring device, and when a connection between the first automatic distribution machine and the monitoring device is faulty, the first automatic distribution machine generates the identifier, sending a request to generate an identifier from the first automatic distribution machine to the monitoring device, and after the request for generating the identifier sent by the first automatic distribution machine is received by the monitoring device, the monitoring device generating the identifier and then communicating the generated identifier from the monitoring device to the first automatic distribution machine, wherein the identifier comprises several parts, one of the parts being specific to the first automatic distribution machine where the malfunction has been detected.

2. The method according to claim 1, wherein the step for generating an identifier comprises a step for encrypting the identifier.

3. The method according to claim 1, wherein the method further includes a step for:

introducing the identifier into the second automatic distribution machine, and the second automatic distribution machine taking an action to compensate for the harm generated by the malfunction having the specific identifier generated from the malfunction being detected at the first automatic distribution machine.

4. The method according to claim 1, wherein the step for generating the one part of the identifier specific to the first automatic distribution machine where the malfunction has been detected an identifier, comprises a step of encrypting the one part of the identifier specific to the first automatic distribution machine.

5. The management system according to claim 4, wherein the one part of the identifier specific to the first automatic distribution machine where the malfunction has been detected is encrypted.

6. A management system for transactions, the system comprising: at least one automatic distribution machine, each said automatic distribution machine including:

a malfunction detector able to detect a malfunction during a transaction of a first automatic distribution machine with a user, the malfunction creating a harm for the user, a unit for generating an identifier with a validity date, at least part of the identifier being specific to the detected malfunction and the identifier being intended to be introduced into a second automatic distribution machine, an introduction of the identifier allowing the second automatic distribution machine to carry out an action to compensate the harm suffered by the user, the validity date preventing the second automatic distribution machine from carrying out an action to compensate the user's harm when an introduction date of the identifier into the second automatic distribution machine is later than the validity date, and a unit for creating a ticket including the identifier; and a monitoring device, wherein each of a plurality of said automatic distribution machines are connected to said monitoring device, wherein the transactions are done by the plurality of said automatic distribution machines, and the monitoring device includes the unit for generating an identifier, wherein the first automatic distribution machine is configured and operated to send a request to generate the identifier to the monitoring device, and wherein the monitoring device is configured and operated to, after the request for generating the identifier sent by the first automatic distribution machine is received by the monitoring device, the monitoring device generates the identifier and then communicates the generated identifier from the monitoring device to the first automatic distribution machine, and wherein the first automatic distribution machine includes a unit for generating the identifier when a connection between the first automatic distribution machine and the monitoring device is faulty, wherein the identifier comprises several parts, one of the parts being specific to the first automatic distribution machine where the malfunction has been detected.

7. The management system according to claim 6, wherein the unit for generating an identifier includes a plurality of sub-units for generating an identifier, each automatic distribution machine and the monitoring device each including a generating sub-unit.

8. The management system according to claim 6, wherein the monitoring device introduces the identifier into the second automatic distribution machine, the second automatic distribution machine taking an action to compensate for the harm generated by the malfunction having the specific identifier generated from the malfunction detected by the malfunction detector at the first automatic distribution machine.

9. The management system according to claim 6, wherein the one part of the identifier specific to the first automatic distribution machine where the malfunction has been detected is encrypted.

* * * * *